United States Patent [19]

Goodman et al.

[11] Patent Number: 4,470,424

[45] Date of Patent: Sep. 11, 1984

[54] HAIR-ROLLER APPARATUS

[75] Inventors: Abraham Goodman, Fort Lee; Murray Jennis, Parsippany, both of N.J.

[73] Assignee: Goody Products, Inc., Kearny, N.J.

[21] Appl. No.: 537,744

[22] Filed: Sep. 30, 1983

[51] Int. Cl.[3] ..... A45D 8/00

[52] U.S. Cl. ..... 132/46 A; 132/40; 132/42 A

[58] Field of Search ..... 132/40, 42, 39, 48, 132/46

[56] References Cited

U.S. PATENT DOCUMENTS

| | | | |
|---|---|---|---|
| 2,598,943 | 6/1952 | Solomon | 132/42 R |
| 2,720,882 | 10/1955 | Solomon | 132/40 |
| 3,109,437 | 11/1963 | Broyles | 132/40 UX |
| 3,144,027 | 8/1964 | Chalfin et al. | 132/40 |
| 3,241,561 | 3/1966 | Richmond | 132/40 |
| 3,590,830 | 7/1971 | Hannum | 132/48 R |
| 3,937,233 | 2/1976 | Hook | 132/40 |

*Primary Examiner*—Gregory E. McNeill

[57] ABSTRACT

The disclosed hair-roller apparatus includes a hair roller that is either hollow such as a cylinder, or that has cavities in its ends, and a hair holder to retain hair wound on the hair roller. The hair holder has a long hook at one end and a short reverse hook at its opposite end. The long hook is received in the hair roller initially in one motion. Mounting of the hair holder against hair wound on the hair roller is completed by shifting the hair holder reversely to move the short hook into the opposite end of the hair roller. The hair holder may also be made using equal-length hooks, plus detents for obstructing lengthwise disengaging shift of the hair holder.

13 Claims, 9 Drawing Figures

FIG. 2
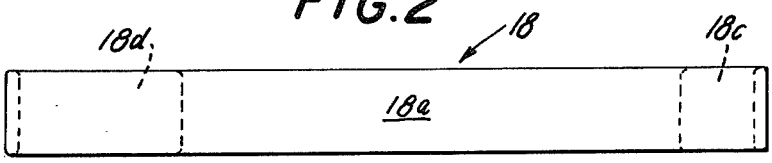
FIG. 1
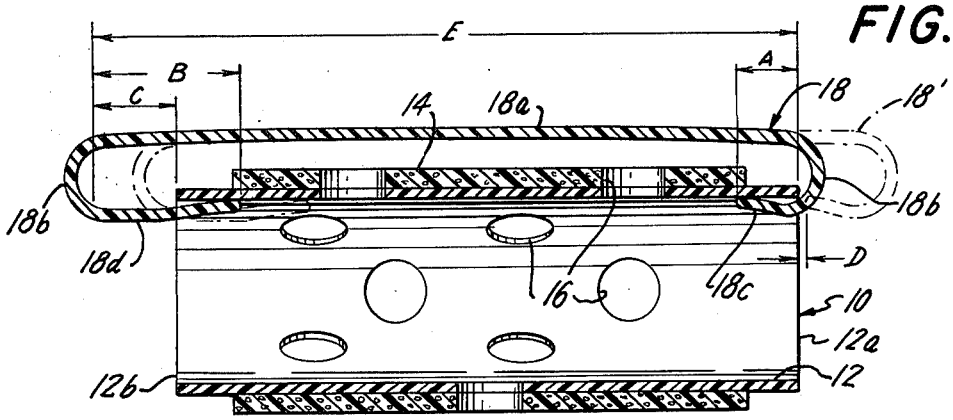
FIG. 3
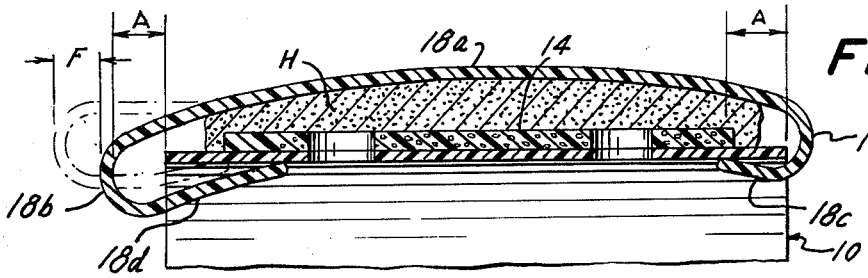
FIG. 4
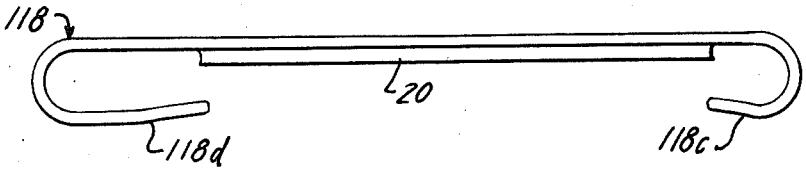
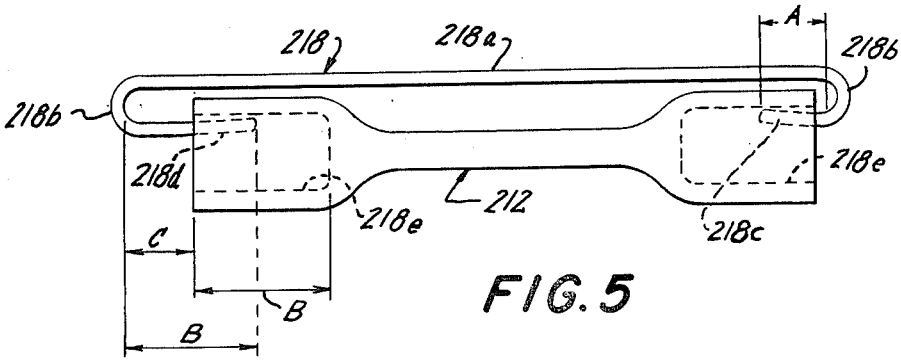
FIG. 5
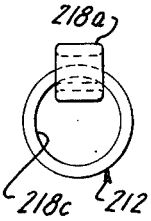
FIG. 6

FIG. 7
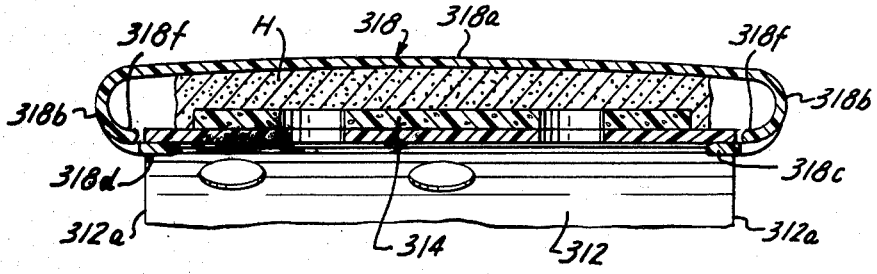
FIG. 8
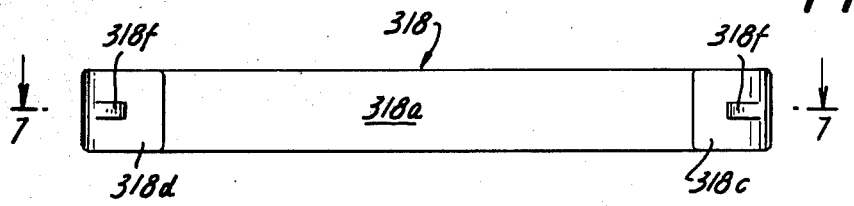
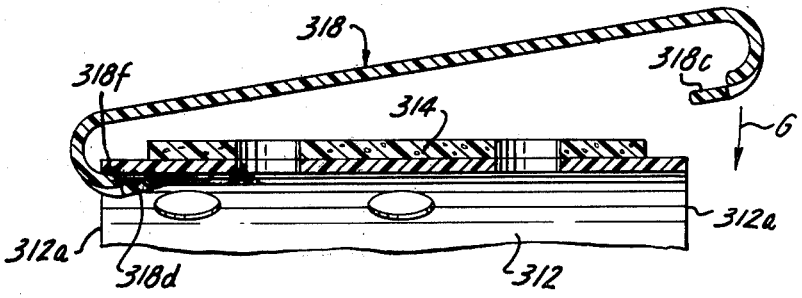
FIG. 9

HAIR-ROLLER APPARATUS

The present invention relates to hair rollers for the human hair, to form waves in the hair or to straighten kinky hair.

In using hair rollers, a lock of hair is wound around a form that is usually hollow and cylindrical (but which may be of reduced diameter between its ends) and then the wound hair is secured against unwinding by what is herein called a "hair holder". When bobby pins or roller fasteners (resembling large bobby pins) are used for this purpose, one leg of such hair holder is pushed inside a hollow roller while the outer leg slides over hair wound on the hair roller. Nearest the connection ("bight") between the legs of such a hair holder, part of the outer leg presses against the hair which lifts and tilts the rest of the outer leg away from the hair without gripping effect. Furthermore, bobby pins and roller fasteners and other slender hair holders tend to develop a localized pattern of objectionable small indentations or waves in the hair. Several bobby pins may be needed for reliably holding the wound hair on the roller, as at opposite ends of the roller. Moreover, using bobby pins is inconvenient since the legs of the bobby pin must be pried apart while one of the user's hands is occupied with holding the hair wound on the roller.

An alternative widely used form of hair roller has a hair-holding bar hinged to one end of the roller, to be latched against the hair after it has been wound on the roller. Characteristically, the hinged hair holder extends lengthwise away from an end of the roller while the hair is being wound. This represents an encumbrance that must be tolerated.

The present invention provides a hair roller with an improved hair-holding bar. The bar itself and its cooperation with the roller are novel. The hair-holding bar is entirely separate from its companion hair roller while the hair is being wound. However, it is readily applied to the roller to hold the wound hair in place and it is also readily removed. In the illustrative embodiments of the invention detailed below and shown in the accompanying drawings, the hair-holding bar comprises a bar portion having integral oppositely directed hooks at its ends. Except for hair rollers of very small diameter, hair rollers are usually made hollow to be light and to limit the amount of material required. The hooks of the hair holder are received in the hollow of the roller, bearing against the inner surface and thereby causing the bar portion to bear against the wound hair on the roller.

The wound hair has a certain amount of "give" so that, even if the bar were rigid, the pressure of the bar against the hair is by no means positive. Moreover, as will be seen below, resilient material on the roller or on the bar portion may be used for softening the pressure of the bar portion against the hair.

The hair-holding bar or "hair holder" includes a "bar portion" for holding the hair wound on the hair roller. The term "hooks" is used herein to refer to portions extending toward each other from bends at the ends of the bar portion. In a distinctive form of the hair holder, the two hooks are of different lengths. They are conveniently called the "long" hook and the "short" hook, these terms being used in their relative sense. The bar portion is made somewhat longer than the roller plus the length of the short hook.

After hair has been wound on the roller, the long hook is slipped inside the hollow roller and the hair-holding bar is shifted to move the long hook all the way in. The bar portion is then pressed against the wound hair while the short hook moves across an edge of the hollow roller and into position to enter the hollow. Finally, the hair-holding bar is shifted reversely to engage the short hook with the inner surface of the hollow. The long hook at the other end of the bar portion remains engaged with the roller because of its greater length. Applying the hair-holding bar is easy and convenient, and subsequently its removal is also quite easy.

In a modification, the hooks of the hair holder are of equal lengths. As in using the embodiment with unequal hooks, one hook is slipped into the hollow of the hair roller while the hair-holding bar is slanted away from the hair roller; the hair holder is swung down to align the second hook with the hollow in the roller; and finally the hair holder is slid along the hair roller until the second hook enters the hollow of the roller. Stops or detents on the hooks are disposed opposite the end edges of the hair roller to retain the hooks in operative position.

The nature of the invention, including the foregoing and other features and advantages, will be best appreciated from the following detailed description of several embodiments that are shown in the accompanying drawings.

In the drawings:

FIG. 1 is a longitudinal cross-section of hair-roller apparatus embodying features of the invention, the hair-holding bar being shown in solid lines and in dotted lines, representing its relation to the hair roller when in use and when partially assembled to the hair roller, respectively;

FIG. 2 is a top plan view of the hair holder of FIG. 1;

FIG. 3 is a fragmentary longitudinal cross-section of the apparatus of FIG. 1 when the hair holder is in position holding hair wound on the hair roller;

FIG. 4 is a modification of the hair holder of FIGS. 1–3;

FIG. 5 is a modification of the novel hair-roller apparatus;

FIG. 6 is a right-end view of the device in FIG. 5.

FIG. 7 is a fragmentary longitudinal cross-section of a hair roller with hair wound thereon and a modified hair holder shown in cross-section at the plane 7—7 in FIG. 8;

FIG. 8 is a bottom plan view of the hair holder of FIG. 7; and

FIG. 9 is a fragmentary cross-section of the embodiment of FIG. 7 as the hair holder is being assembled to the hair roller.

Referring now to FIGS. 1–3, hair roller 10 is shown as comprising a cylinder 12 bearing a soft foamed plastic wrap 14. The cylinder and the wrap have aligned ventilating apertures 16.

A hair holder on hair-holding bar 18 is shown in solid lines in FIG. 1 in its fully assembled relation to the hair roller, in the absence of hair. This is the same relationship that would exist with only a small amount of hair wound on the hair roller. Hair holder 18 includes a bar portion **18*a* having bends 18*b* and two "hooks" 18*c* and 18*d* extending toward each other from the respective bends 18*b*. Hook 18*c* is "short" and hook 18*d*** is "long", these being relative terms.

When hair holder 18 is in its solid-line position, the place where hook **18*c* joins its bend 18*b* bears against end edge 12*a*** of the cylinder; the length A of short hook 18*c* extends into the hollow of cylinder 12; and only part of the length B of hook 18*d* extends into the hollow of cylinder 12. End edge 12*b* of cylinder 12 is spaced a distance C from the juncture of long hook 18*d* with its bend 18*b*.

With hair holder 18 in its dotted position (designated 18' in FIG. 1) the free end of short hook 18*c* is spaced by a distance D from end edge 12*a* of the hair roller. In this condition of the hair holder 18, the juncture of long hook 18*d* with its bend 18*b* engages edge 12*b*. Hook 18*c* can be lifted to pass by edge 12*a* of the hair roller. Thereafter the hair holder 18 can be shifted bodily to the left and thus removd from the hair roller.

Hair holder 18 is to be mounted on the hair roller when hair has been wound on the roller. To do this, hook 18*d* is tucked into the cavity of the hair roller while the righthand end of bar portion 18*a* is spaced from the hair roller. The hair holder is shifted to the right until the bend 18*b* at the left engages edge 12*b* of the hair roller. Then the hair holder is swung into the dotted-line position of FIG. 1 for hook 18*c* to enter the hair-roller cavity. Finally, the hair holder 18 is shifted to the left into its solid-line position. Portions of short hook 18*c* and long hook 18*d* bear against the inner surface of cylinder 12 when bar portion 18*a* of the hair holder presses against hair wound on the hair roller (not shown in FIG. 1).

Bar portion 18*a* may be considered as terminating at its transitions into bends 18*b*, i.e. in vertical alignment (as seen in FIG. 1) with the junctures of hooks 18*c* and 18*d* with bends 18*b*. Accordingly, the minimum length E of bar portion 18*a* is the length of cylinder 12 plus the length A of short hook 18*c*, preferably adding length D. (C=A+D).

When hair holder 18 is forced onto a particularly thick mass of wound hair, bar portion 18*a* becomes bowed outward as represented in FIG. 3. At the right, the juncture of bend 18*b* and hook 18*c* is arrested by end edge 12*a* of the hair roller. The hair holder that is represented in dotted lines in FIG. 3 in its unstressed condition is foreshortened somewhat by a thick mass of hair as represented by hair holder 18 shown in solid lines in FIG. 3. If the hair holder is to be removed from that solid-line position, bar portion 18*a* must be somewhat longer than the minimum mentioned above. That minimum may be increased by a length F (FIG. 3) to allow for the curvature-induced foreshortening. This means, simply, that distance C is appreciably greater than length A of the short hook 18*b*. In any case, the distance separating the free ends of hooks 18*c* and 18*d* should be substantially less than the length of cylinder 12.

Only nominal skill is needed to mount and to remove hair holder 18. Being entirely separable from roller 12, it does not constitute an encumbrance while hair is being wound on the roller. It should be relatively wide in order to avoid forming a crimp in the wound hair. Making it of sturdy yet flexible plastic contributes further to avoiding formation of crimps or a localized pattern of small waves in the hair.

The soft foamed wrap 14 on cylinder 12 provides a cushion for preventing firm pressure from developing under bar portion 18*a* when a thick lock of hair is wound onto the roller. This cushion provides a further safeguard against sharp crimps forming in the wound hair. Correspondingly, by modifying the hair holder in the manner shown in FIG. 4, the hair holder is adapted for securing a range of different thicknesses of wound hair without causing crimping. In FIG. 4, hair holder 118 is like hair holder 18 in all respects except that a layer of soft resilient foamed plastic 20 is adhered to the surface of the hair holder facing the hair roller, i.e. the side of bar 118 opposite which hooks 118*c* and 118*d* are disposed. Wrap 14 may be used or omitted.

The hair holders of FIGS. 1–3 and FIG. 4 may be used with hair rollers having a range of different diameters. Indeed, hair holder 218 (FIG. 5) may be used with a very slender hair roller 212 having cavities in its ends to receive hooks 218*c* and 218*d*. The form of roller in FIG. 5 does not have a cylindrical winding surface for the hair but, instead, its diameter is quite small along its midsection and it increases toward the ends. Bar portion 218*a* may be straight (as shown) or it may be somewhat bowed toward roller 212. The same distance C is provided in FIG. 5 between the left-hand end of roller 212 and the bend 218*b* at the left of the hair holder as in FIGS. 1–3, and both cavities in the roller ends are deep enough to receive long hook 218*d*. In both examples, while the hair holder is moderately resilient, the hair holder can be applied and released without dependence on the resilience. This feature results from the different-length hooks that are provided and from the excess length of the hair holder as compared to the length of the hair roller. That excess length and the depth of the cavity that receives the long hook accommodate slide-release of the hair holder.

It has been indicated that bar portion 18*a* is relatively wide, in contrast to bobby pins. For example, hair holder 18 is about one-half inch wide. When used on a hair roller whose cylinder 12 is $\frac{7}{8}$-inch in diameter, the lateral edges of bar portion 18*a* have little tendency to form crimps in the wound hair. A $\frac{1}{2}$-inch wide bar portion 18*a* occupies an angle of about 60° on such a cylinder. On larger-diameter cylinders, the entire wide and flat surface of the hair-holding bar is approximately tangent to the wound hair. On small-diameter rollers of the type represented in FIG. 5, the diameter of the roller at its midpoint may be only approximately $\frac{1}{8}$-inch and the maximum diameter at the ends may be only $\frac{1}{4}$-inch, and the wound hair may be only one-half inch in diameter. With such rollers, portion 218*a* may be the same as that of hinged hair holders used with such rollers, e.g. 3/16-inch wide. Indeed, where the effect of bobby pins is considered inconsequential, the hair-holding bar could be as slender as a bobby pin but for the stiffness requirement, to enable it to serve as a hair holder.

Due to the hollow in roller 12 of FIG. 1 and the equally deep cavities 218*e* in the roller 212 of FIG. 5, each hair roller can receive as much of the long hook as may be necessary for applying or removing the hair-holding bar 18 or 218. Accordingly, the user need not be concerned with a "right" or "wrong" end for inserting the long hook into the roller.

FIGS. 7–9 show an alternative construction, in which the hooks of the hair holder are of equal length rather than the unequal-length hooks as in FIGS. 1, 4 and 5.

Hair holder 318 has a hair-holding bar 318 having equal-length hooks 318*c* and 318*d* extending from bends 318*b* at the ends of bar 318*a*. Stops or detents 318*f* project into line with the end edges 312*a* of cylinder 312. Bar 318*a* is bowed when pressing hair H against the hair roller; and this curvature in a sense foreshortens the hair holder, i.e. draws the ends closer together than they are in the unstressed condition of the hair holder. Accordingly, stops 318*f* are spaced apart sufficiently to abut cylinder ends 312*a* when the anticipated amount of hair is wound on the hair roller.

FIG. 9 illustrates how to assemble hair holder 318 to hair roller 312. Hook 318*d* is inserted fully into the hollow of the roller, with bar 318*a* slanting upward. Hook 318*c* is clear of the end 312*a* of the hair roller, so it can be swung down (arrow G) into line with the hollow of cylinder 312. Then the hair holder is shifted to the left until (at the left in the drawing) stop 318*f* slips past the edge 312*a*. The gripped hair (FIG. 7) presses hooks 318*c* and 318*d* against the inner surface of cylinder 312 so that stops 318*f* are retained in position opposite the cylinder ends 312*a*.

The hair holder is released by pressing either hook down, to shift its stop out of line with its opposed cylinder end 312*a*, and then that hook can be pushed into the cylinder hollow to release the other hook. The manipulation is essentially the same as in the embodiments of FIGS. 1, 4 and 5. Indeed, a stop may be added to each of hooks 18*d*, 118*d* and 218*d* corresponding to stops 318*f*, in FIG. 7, for like purpose.

Hair rollers 18, 118, 218 and 318 typically are about 2½ inches to 3-inches long. Each of hooks 18*c* and 18*d* in FIG. 1 is about one-quarter inch long and at least 5/16-inch long in an example so that, correspondingly, bar portion 18*a* is about 2¾ to 3¼ inches long. Preferably the hair holders of FIGS. 1, 4, 5 and 7 are still longer by about 150-inch i.e., about 2⅞ inches to 3⅜ inches long. In the form shown, the hair holders are much wider than they are thick, yet when made of intrinsically light-weight plastic they are typically 1/16-inch thick and have rounded edges and corners throughout.

The foregoing illustrative hair-roller apparatus may be modified widely by those skilled in the art so that the invention should be construed broadly, consistent with its true spirit and scope.

What is claimed is:

1. Hair-roller apparatus including a hair roller that is hollow at least at the ends thereof, and a hair-holding bar entirely separable from the hair roller for facilitating winding of hair about the roller, the hair-holding bar including a bar portion having reverse bends at its extremities, and said hair-holding bar having a long hook and a short hook extending toward each other from said bends, said hooks being spaced from a common side of the bar portion for entering the hair roller at the ends thereof when the bar portion is displaced along the exterior of the hair roller, the length of said bar portion being at least equal to the length of the hair roller plus the length of the short hook, and the ends of said hooks that are closest to each other being separated substantially less than the length of the hair roller.

2. Hair-roller apparatus as in claim 1 wherein said bar portion is resilient and the hair-holding bar becomes somewhat foreshortened when holding a thick winding of hair on the hair roller, the length of the bar portion being greater than the length of the short hook plus the length of the hair roller by an allowance for the foreshortening.

3. Hair-roller apparatus as in claim 1, wherein said bar portion is of the order of one-half inch in width.

4. Hair-roller apparatus as in claim 1, wherein soft sponge material forms a warp around the hair roller.

5. Hair-roller apparatus as in claim 1, wherein said bar portion has a layer of soft sponge material on the side thereof facing the hair roller.

6. Hair-roller apparatus as in claim 1, wherein said hair roller is a hollow cylinder whose inner diameter is much larger than the largest transverse dimension of said hooks.

7. Hair-roller apparatus as in claim 1, wherein said hair roller is solid except for cavities in its ends proportioned to receive the whole lengths of said long and short hooks.

8. Hair-roller apparatus as in claim 1, wherein said hooks are offset from the axis of the hair roller.

9. Hair-roller apparatus including a hair roller that is hollow at least at the ends thereof, and a hair-holding bar entirely separable from the hair roller for facilitating winding of hair about the roller, the hair-holding bar including a bar portion having reverse bends at its extremities, and said hair-holding bar having a pair of hooks extending toward each other from said bends, said hooks being spaced from a common side of the bar portion for entering the hair roller at the ends thereof when the bar portion is displaced along the exterior of the hair roller, the length of the bar portion being at least equal to the length of the hair roller plus the length of a said hook, and the ends of the hooks that are closest to each other being separated substantially less than the length of the hair roller.

10. Hair-roller apparatus as in claim 9, wherein the hooks have detents opposite the ends of the hair roller when the hooks are pressed against the inner surface of respective hair roller.

11. A hair-holding bar proportioned for holding hair wound on a hair roller having hollows at the ends thereof, sad hair-holding bar including a moderately resilient bar portion for holding hair wound on a roller, said bar portion having reverse bends at its extremities, and said hair-holding bar having hooks extending toward each other from said bends, said hooks being spaced from a common side of the bar portion for entering the hair roller at the ends thereof when the bar portion is displaced along the exterior of the hair roller, the length of said bar portion being much greater than the combined lengths of the hooks.

12. A hair holder as in claim 9, wherein one of said hooks is substantially longer than the other.

13. A hair holder as in claim 9, said bar portion being about ⅜ to ½-inch wide and about 3 to 3½ inch long.

* * * * *